United States Patent [19]

Reda et al.

[11] 4,312,155

[45] Jan. 26, 1982

[54] APPARATUS FOR GRINDING GROOVES IN THE INNER RACE OF A CONSTANT VELOCITY UNIVERSAL JOINT

[75] Inventors: Kazimierz Reda, Springfield; Roald Cann, Wethersfield; Lawrence A. Ambrose, Springfield, all of Vt.

[73] Assignee: Bryant Grinder Corporation, Springfield, Vt.

[21] Appl. No.: 147,983

[22] Filed: May 8, 1980

[51] Int. Cl.[3] ..... B24B 5/00

[52] U.S. Cl. ..... 51/105 R; 51/108 R; 51/216 ND; 51/237 R

[58] Field of Search ..... 51/216 ND, 105 R, 105 SP, 51/108 R, 237 R

[56] References Cited

U.S. PATENT DOCUMENTS 2,414,784 1/1947 Wright ..... 51/108 R 3,934,378 1/1976 Ditzel ..... 51/216 ND

*Primary Examiner*—Harold D. Whitehead

*Attorney, Agent, or Firm*—Reising, Ethington, Barnard, Perry & Brooks

[57] ABSTRACT

A grinding machine (10) includes apparatus for grinding grooves in inner races (16) of constant velocity universal joints with a high production output achieved by indexing of a race without stopping rotation of a holder (14) on which the race is clamped for rotation during the grinding. An indexer (46) of the apparatus is supported for rotation with the holder (14) and provides the indexing of the race about a central axis C thereof as the holder rotation proceeds. A locater (48) also rotates with the holder (14) and accurately locates the race after indexing to provide alignment thereof with the grinding wheel (12) that performs the grinding. A jaw operator (44) controls first and second jaws (40,42) of the holder clamp and has a high clamp mode for fixing the race during the grinding and a low clamp mode for permitting the indexing and locating operations as well as an unclamp mode that permits a ground race to be unloaded and another race to be loaded onto the holder in preparation for the next cycle.

15 Claims, 2 Drawing Figures

APPARATUS FOR GRINDING GROOVES IN THE INNER RACE OF A CONSTANT VELOCITY UNIVERSAL JOINT

TECHNICAL FIELD

This invention relates generally to grinding and, more particularly, to apparatus for grinding grooves in the inner race of a constant velocity universal joint.

BACKGROUND ART

Constant velocity universal joints interconnect driving and driven shafts in a manner that permits relative angular movement between the rotational axes of the shafts while still providing constant angular velocity of the driven shaft at the same rate as the driving shaft throughout each revolution. Inner and outer races of such joints are respectively connected to the shafts and each race has pairs of diametrically opposite grooves which are spaced circumferentially and receive ball elements for interconnecting the races. Each groove defines a partially circular arc and has a partially circular or arch cross section of less than 180° so as to receive one side of the associated ball element whose other side is received within an aligned groove in the other race. Grooves in the inner race face outwardly toward the outer race, while the grooves in the outer race face inwardly toward the inner race which is received within the outer race. During angular movement between the rotational axes of the driving and driven shafts connected to the races, forces applied to the ball elements by a cage provide movement of the ball elements along the grooves in order to maintain the ball elements in a plane which bisects the angle between the rotational axes. As such, the rotational speed of the driven shaft is always the same as that of the driving shaft throughout each revolution. Each race groove and ball element must be ground to a relative precise tolerance, on the order of about one to several ten thousandths of an inch, in order to maintain the ball element positioning that results in the constant speed driving and so that the ball elements uniformly share the torque load without overloading one or a few of the ball elements.

Conventional grinding machines for grinding the inner races of constant velocity universal joints include a rotatable grinding wheel and a rotatable race holder whose axes of rotation are parallel to each other. Movement of the rotating grinding wheel toward the rotating holder with a race held thereon engages the wheel with a pair of diametrically opposite grooves in the race to perform grinding of one pair of grooves at a time. After one pair of grooves is ground, the grinding wheel is moved away from the holder and the holder rotation is then momentarily stopped to permit rotational indexing of the race. Thereafter, the holder is again rotated to grind the next pair of diametrically opposite grooves. Production output of such grinding machines is limited by the necessity of stopping and then starting the holder rotation for the indexing prior to grinding each pair of grooves, and this limited output is necessarily reflected in the cost of the constant velocity universal joint with which the ground inner race is incorporated.

DISCLOSURE OF INVENTION

An object of the present invention is to provide greater production output is grinding grooves of inner races for constant velocity universal joints.

In carrying out the above object and other objects of the invention, apparatus for performing the grinding includes an induxing means or indexer that rotates with a holder thereof and indexes the race within a clamp of the holder as rotation proceeds so that each pair of grooves in the race can be ground without stopping the holder rotation.

A locater that rotates with the holder is also preferably provided so as to accurately locate the race in cooperation with the clamp of the holder prior to grinding each pair of grooves in order to provide proper alignment with the grinding wheel that performs the grinding.

In the preferred construction disclosed, the clamp for holding the race being ground includes first and second jaws pivotally mounted on the holder and also includes a fluid jaw operator having a high clamp mode for positioning the jaws to hold the race in a fixed relationship on the holder during grinding of each pair of grooves. The jaw operator has a low clamp mode for permitting indexing and locating movement of the race as the holder rotation proceeds. First and second ends of the holder on which the first and second jaws are respectively mounted are connected by a reduced size connecting portion that defines a mounting face against which the inner race is clamped during the grinding. Each jaw has a pivotal connection on the associated end of the holder with an axis that extends parallel to the mounting face. A clamping end of each jaw engages the inner race to provide the clamping thereof against the mounting face in cooperation with the other jaw. Springs normally bias the clamping ends of the jaws away from each other to unclamped positions.

The fluid jaw operator is preferably mounted on the first end of the holder and has a first actuator that engages the first jaw on the same side of the pivotal axis thereof as its clamping end in order to provide a clamping bias of the first jaw toward the second jaw. A second actuator of the jaw operator extends through the connecting portion of the holder from the jaw operator to the second end of the holder so as to engage the second jaw on the opposite side of the pivotal axis thereof as its clamping end in order to provide a clamping bias of the second jaw toward the first jaw upon biasing of the second actuator by the jaw operator in the same direction that provides the clamping bias of the first jaw by the first actuator. With this jaw construction, any variation in size of the inner races being ground is compensated for such that the center of the race is always positioned at the same location on the holder during the grinding.

Preferably, the clamping end of the first jaw includes a pair of clamping portions that are spaced circumferentially with respect to the race in its clamped position, and the clamping end of the second jaw includes a single clamping portion that engages the clamped race in an equal circumferentially spaced relationship from each clamping portion of the first jaw. Each of the three clamping portions is embodied by a replaceable carbide insert that is resistant to wear and has a partially conical clamping surface for engaging a partially spherical outer surface on the race to provide the clamping.

The fluid jaw operator includes a piston and a spring that biases this piston in a direction which moves the first and second actuators of the jaws so as to provide the clamping bias that moves the jaws toward each other. A first passage selectively feeds pressurized fluid to one side of the jaw operator piston so as to cooperate with the spring to provide the high clamp mode of the jaw operator. A second passage selectively feeds pressurized fluid to the other side of the jaw operator piston so as to move this piston against a spring bias thereof in order to provide the low clamp mode of the jaw operator. With this construction upon any termination of the pressurized fluid during a grinding operation, the jaws are maintained in a clamped condition so as to hold the race in position until the holder rotation can be stopped. After grinding is completed, pressurized fluid is fed through the second passage with a greater pressure than in the low clamp mode to provide an unclamp mode that moves the piston of the jaw operator in order to permit the spring bias of the jaws to provide unclamping pivoting thereof such that the ground race can be removed and an unground race can be clamped to begin the next cycle.

Both the indexer and the locater are preferably mounted on the second end of the holder opposite the first end thereof on which the jaw operator is mounted. Fluid actuators of the indexer and the locator each include a piston and a biasing spring that biases the piston thereof, the indexer piston bias being in a retracting direction and the locater piston bias being in an extending direction. Pressurized fluid selectively supplied to the actuator piston of both the indexer and the locater controls the indexing and the locating operations during each grinding cycle.

In its preferred construction, the actuator of the indexer includes an indexing member mounted for movement on the piston thereof, and the spring of the indexer actuator biases the piston thereof in a retracting direction so as to move the indexing member away from the race clamped by the jaws. A passage supplies pressurized fluid to the indexer piston to provide extending movement thereof against the spring bias in order to engage the indexing member with one of the race grooves so as to provide indexing of the race with the jaws clamping the race in the low clamp mode in order to permit the indexing to take place.

A pivotal connection preferably mounts the indexing member of the indexer on the piston of the indexer actuator, the engageable stop surfaces on this member and piston limit pivoting of the indexing member as pressurized fluid moves the indexer piston against its spring bias to index the clamped race. A spring that normally biases the indexing member to engage the stop surfaces deflects to permit disengagement thereof as the indexer piston is moved by its spring bias in a retracting direction after the indexing of the clamped race. Such deflection allows the indexing member to move out of the race groove which was engaged to provide the indexing so that this groove and the diametrically opposite race groove are unobstructed such that the grinding wheel can then be moved into position for providing grinding of these grooves. The indexer piston preferably moves along a direction that defines an angle of approximately 12° with the axis of holder rotation such that the indexing member does not pivot to disengage the stop surfaces as the indexing is performed.

A sensor of the indexer senses the location of the indexer piston so as to prevent the grinding wheel from moving into position for grinding prior to the retracting movement of the indexer piston and concomitant movement of the indexing member carried thereby out of the race groove engaged thereby in alignment with the grinding wheel. A proximity switch of the indexer sensor is mounted on a base of the machine while a switch actuator thereof is supported on one end of a lever whose other end is support for rotation with the race holder and for pivoting in response to movement of the indexer piston. A spring biased plunger positions the lever in engagement with the indexer piston such that the switch actuator is moved toward and away from the proximity switch. Upon each revolution, suitable circuitry senses the switch actuation or lack thereof so as to provide a control signal responsive to the position of the indexer piston.

The locater includes a locating member mounted for movement with the locater piston in a radial direction with respect to the clamped race, and the spring of the locater actuator biases the piston thereof in an extending direction toward the clamped race. Passages selectively supply pressurized fluid to the locater piston to provide extending movement thereof for accurately locating the race and opposite retracting movement prior to the next indexing operation. The locating member carried by the locater piston engages one of the race grooves upon the extending piston movement in order to provide the proper rotational position of the race. As with the indexing, the locating is performed with the jaw operator in its low clamp mode such that the clamped race can be moved rotationally about its central axis.

A sensor of the locater senses the position of the locater piston to insure that the clamped race is located prior to movement of the grinding wheel that commences grinding of the pair of race grooves aligned with the wheel. A proximity switch of the locater sensor is mounted on a base of the machine while a switch actuator thereof is mounted for movement with the locater piston. Upon each revolution, suitable circuitry senses the switch actuation or lack thereof so as to insure accurate race location prior to grinding.

It should be noted that either hydraulic or pneumatic fluid can be used to control the jaws, indexer, and locater. However, in most instances use of hydraulic fluid will facilitate construction and operation.

BEST MODE FOR CARRYING OUT THE INVENTION

Figure 1:
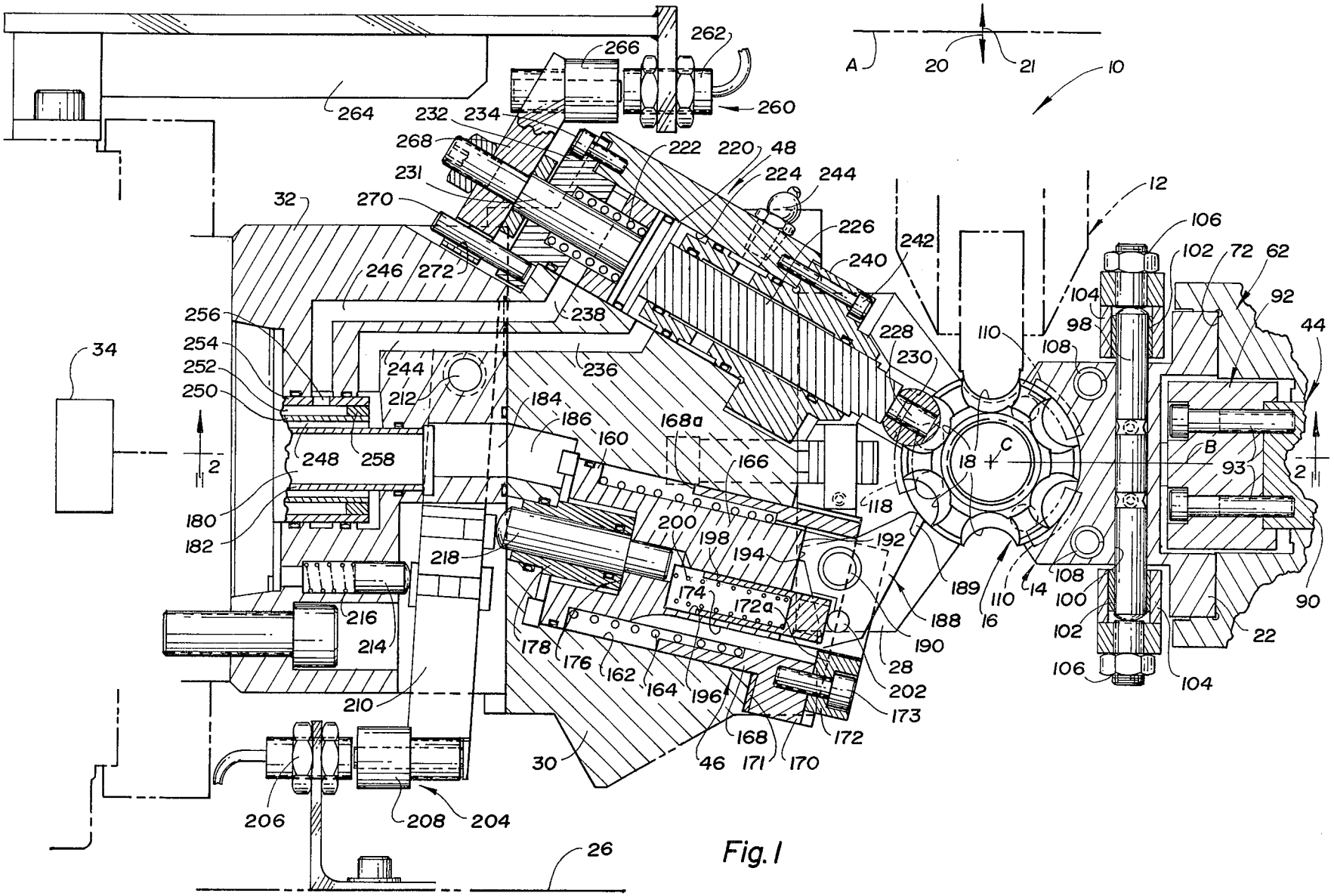
FIG. 1 is a sectional view taken through a grinding machine including apparatus constructed in accordance with the present invention.

Referring to the drawings, a grinding machine including apparatus constructed in accordance with the present invention is collectively indicated by reference numeral 10 and is operable to grind grooves in the inner race of a constant velocity universal joint with a much greater production output than is possible with conventional grinding machines of this type. Grinding machine 10 includes a grinding wheel 12 (FIG. 1) that it rotatable about an axis A and also includes a holder 14 which supports a constant velocity universal joint inner race 16 for rotation about an axis B parallel to axis A. Race 16 has a somewhat ring-like shape as viewed in FIG. 1 with a central axis C about which the race rotates during use as a component of a constant velocity universal joint. Circumferentially spaced grooves 18 of the race 16 receive ball elements to provide interconnection of the inner race 16 with an associated outer race upon assembly of the joint.

Grinding wheel 12 shown in FIG. 1 is movable transversely with respect to its rotational axis A toward and away from holder 14 as shown by arrows 20 and 21 in order to provide grinding of the grooves 18 in the race 16. As the rotating grinding wheel 12 is moved in the direction of arrow 20 toward the rotating holder 14, the outer edge of the wheel engages a pair of diametrically opposite grooves 18 in the race 16 on the holder in order to provide precise grinding of the race grooves. After grinding the first pair of grooves, the grinding wheel 12 is moved away from the race 16 in the direction of arrow 21 in order to permit indexing of the race about its axis C in preparation for grinding the next pair of diametrically opposite grooves and so on. After grinding all three pairs of grooves 18, the ground inner race 16 is removed from the holder 14 and another race is mounted thereon in order to start the next grinding cycle. Grinding wheel 12 and holder 14 can be rotated in opposite rotational directions such that the cutting speed is the total of their surface speeds at the grinding interface. Alternatively, the wheel and holder can be rotated in the same rotational directions at appropriate rates such that the cutting speed is the difference between their surface speeds at the grinding interface.

Figure 2:
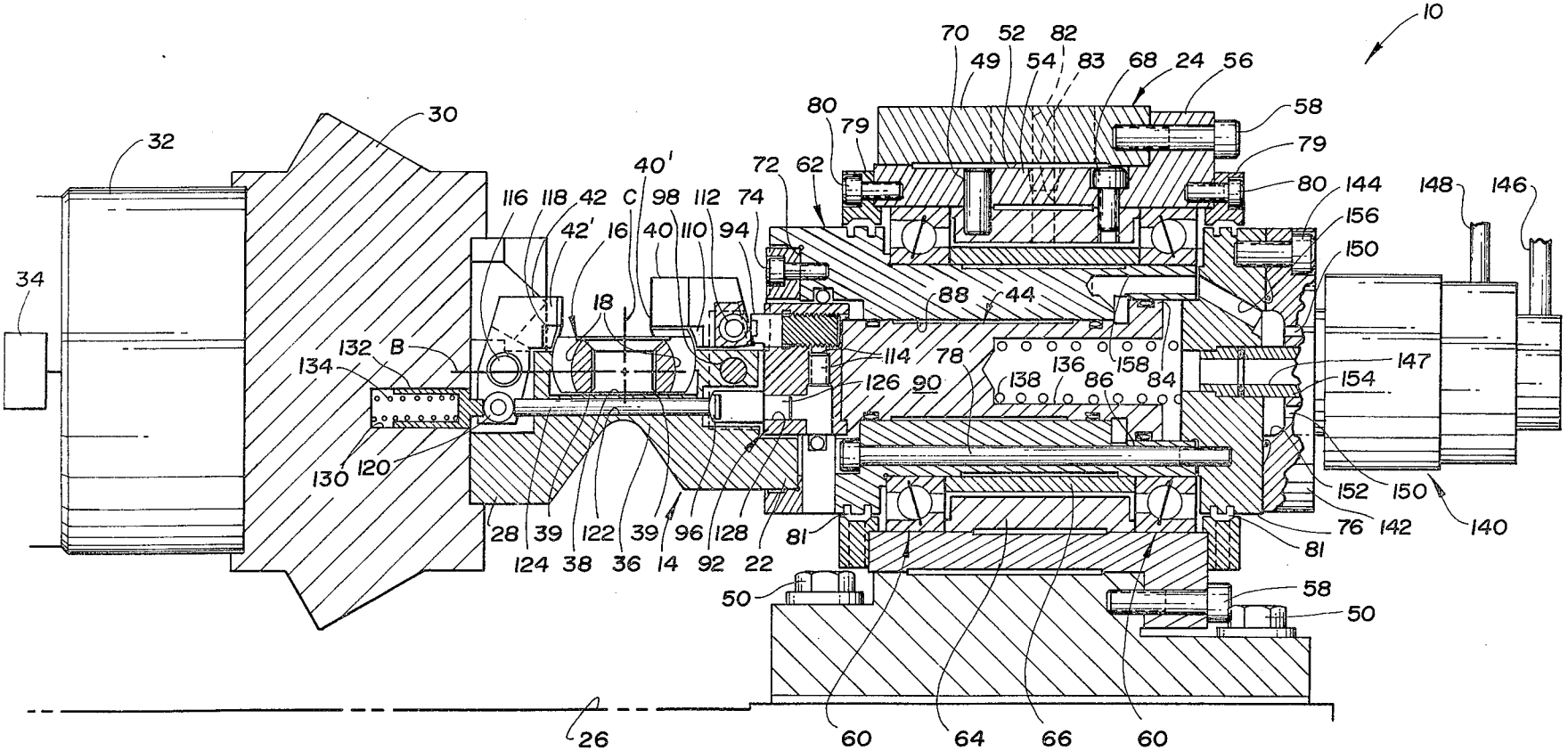
FIG. 2 is a sectional view taken through the grinding machine generally along line 2—2 of FIG. 1.

As best seen in FIG. 2, race holder 14 has a first end 22 which is rotatably supported about axis B by a bearing assembly 24 mounted on a machine base 26. A second end 28 of the race holder 14 is supported for rotation about axis B by a holder adapter 30 which in turn is supported by a rotatable spindle adapter 32 driven by a conventional drive mechanism 34 of the grinding machine. A reduced sized connecting portion 36 of the holder 14 extends between the first ad second holder ends 22 and 28 and defines a mounting face 38 against which the race 16 is held during the grinding. Spaced carbide inserts 39 on the mounting face 38 prevent wear of the holder as the race 16 is indexed in a manner than is hereinafter described.

With continuing reference to FIG. 2, holder 14 includes a clamp having first and second jaws 40 and 42 respectively mounted on the first and second holder ends 22 and 28 and controlled by an operator 44 so as to cooperate in clamping the race 16 against the mounting face 38 in a fixed relationship during the grinding while permitting indexing of the race on the holder as the holder rotation proceeds. An indexing means or indexer 46 of the machine is mounted on the holder adapter 30 adjacent the second holder end 28 as shown in FIG. 1 and rotates with the holder in order to provide indexing of the clamped race 16 without stopping the holder rotation. This capability of indexing the race 16 as the holder rotation proceeds enables the grinding apparatus of this invention to provide much greater output than is possible with conventional grinding machines of this type wherein the holder must be stopped in order to provide indexing.

A locater 48 shown in FIG. 1 is also mounted by the holder adapter 30 for rotation with the holder adjacent its second end 28 and accurately locates the clamped race 16 about axis C after the indexing by the indexer 46 in order to insure that the grooves 18 ground into the race are circumferentially located in an accurate manner with respect to each other. As is more fully hereinafter described, the jaw operator 44 shown in FIG. 2 has a high clamp mode for securely positioning the clamped race 16 during the grinding operation and has a low clamp mode which permits both the indexer 46 and the locater 48 shown in FIG. 1 to move the clamped race 16. After grinding, an unclamp mode of the jaw operator 44 permits a ground race 16 to be unloaded and another race to be ground to be loaded.

With reference to FIG. 2, the jaw operator 44 is rotatably mounted by the bearing assembly 24 which includes a stationary housing 49 whose lower flanged extremity is secured to the machine base 26 by bolts 50. A central opening 52 of the housing 49 receives a sleeve-shaped bearing adapter 54 with a flanged end 56 that is secured to the housing by circumferentially spaced bolts 58. A pair of spaced antifriction bearings 60 are received within the adapter 54 and have outer races mounted thereby as well as inner races which support a rotatable spindle 62 on which the holder 14 is rotatably supported. Outer and inner spacers 64 and 66 of annular shapes are received between the two antifriction bearings 60 and respectively engage the outer and inner races thereof in order to maintain the spaced relationship between the bearings. A bolt 68 and pin 70 extend between the sleeve adapter 54 and the outer spacer 64 at the upper extremity thereof in order to maintain this spacer stationary with the adapter, while the inner spacer 66 rotates with the inner bearing races and with the spindle 62.

A first end of the rotatable spindle 62 shown in FIG. 2 includes a recess 72 that receives the first end 22 of the holder 14 in a fixed relationship provided by circumferentially spaced bolts 74, only one of which is shown. A second end of the spindle 62 has a manifold 76 secured thereto by circumferentially spaced bolts 78, only one of which is shown. A pair of seal rings 79 secured to the bearing adapter 54 by associated bolts 80 cooperate with the end of the spindle 62 adjacent the holder 14 and with the manifold 76 at the outer end of the spindle to provide labyrinth seals 81. An oil-mist lubricant is supplied through passages 82 and 83 in the housing and bearing adapter and escapes through seals 81 so as to thereby provide a sealed environment for the bearings as well as providing lubrication thereto during use.

With reference to FIG. 2, the jaw operator 44 includes a piston 84 of a round cross-section received within a bore 86 defined in the spindle 62 concentric with the axis B about which the holder 14 is rotated. A reduced diameter bore 88 through the spindle 62 receives a piston connecting rod 90 whose left distal extremity is secured to an actuator connector 92 by bolts 93 as shown in FIG. 1. First and second actuators 94 and 96 (FIG. 2) for respectively controlling the movement of the first and second jaws 40 and 42 are each mounted by the connector 92 for hydraulically actuated movement with the piston 84.

The first jaw 40 shown in FIG. 2 is pivotally supported by a pin 98 which extends parallel to the holder mounting face 38 and, as best seen in FIG. 1, projects through a hole 100 in the first holder end 22. Opposite ends of pin 98 are received within bushings 102 in spaced lower legs 104 of the first jaw. Threaded stud and locknut positioners 106 on the jaw legs 104 engage the axial ends of pin 98 in order to limit movement of jaw 40 along the length of the pin. Helical springs 108 have lower ends received within associated holes in the first holder end 22 as shown in FIG. 1 and extend upwardly therefrom so as to bias a clamping end 40' of the first jaw clockwise (as viewed in FIG. 2) about the pivotal connection provided by pin 98. A pair of clamping portions embodied by carbide inserts 110 are secured to the clamping end 40' of the first jaw in a suitable manner such as by a brazing operation and have partially conical surfaces that engage the outer surface on the inner race 16 between the grooves 18 thereof in order to provide clamping of the race. These carbide inserts are spaced circumferentially with respect to the axic C of the clamped race as best seen in FIG. 1.

A roller 112 (FIG. 2) supported by the first jaw 40 of the same side of the pivotal axis of pin 98 as the clamping jaw end 40' is engaged by the first actuator 94 in order to provide counterclockwise movement of the clamping jaw end toward the second jaw 42 upon hydraulically actuated movement of the piston 84 toward the left. Actuator 94 is threaded into the connector 92 and adjustably secured by a plug and set screw lock 114 so as to permit adjusting movement of the first jaw 40 with respect to the second jaw 42 which is controlled by the second actuator 96.

As seen in FIG. 2, the second jaw 42 is pivotally mounted on the second end 28 of the holder 14 by the pivotal connection provided by a pin 116 and has a clamping end 42' on which a clamping portion embodied by a carbide insert 118 is secured in a suitable manner such as by brazing. Carbide insert 118 is located in an equally spaced circumferential relationship from the carbide inserts 110 as shown in FIG. 1 and has a partially conical surface for clamping the outer surface of the race 16 between its grooves 18. On the opposite side of the pivotal axis of pin 116 from its clamping end 42', the second jaw 42 includes a roller 120 for controlling pivotal movement of the second jaw about its mounting pin which has an axis parallel to the holder mounting face 38. An axial hole 122 extending through the connecting portion 36 of the holder 14 between its first and second ends 22 and 28 receives an extension rod 124 of the actuator 96. One end of rod 124 is engaged with the roller 120 while the opposite end thereof is engaged with the second actuator 96 which includes a mounting pin 126 that is fixed within a hole 128 in the connector 92 that moves with the piston 84 of the jaw operator 44. Holder adapter 30 includes an axial hole 130 that receives a plunger 132 and a spring 134 for biasing the plunger into engagement with the roller 120 and thereby providing counterclockwise biasing of the jaw 42 while maintaining its roller in engagement with the actuator extension rod 124. Both jaws 40 and 42 are thus spring biased toward an unclamped or open position so as to insure opening thereof upon opening movement of the hydraulically actuated piston 84.

Jaw operator piston 84 illustrated in FIG. 2 includes a central bore 136 that receives a helical spring 138. One end of spring 138 is seated by the inner end of the piston bore 136 while the other end of the spring is seated by the manifold 76 such that the spring normally biases piston 84 toward the left and likewise biases the first and second jaw actuators 94 and 96 in the same direction. The first jaw actuator 94 thus biases the roller 120 on the first jaw 40 counterclockwise about the associated mounting pin 98 so as to bias the clamping end 40' of this jaw toward the clamping end of the other jaw. Likewise, the second actuator 96 thus biases the extension rod 124 thereof toward the left to urge the roller 120 clockwise about the associated mounting pin 116 so as to bias the clamping end 42' of the second jaw toward the clamping end of the first jaw. Thus, the spring bias of the piston 84 normally tends to close the jaws in a clamping relationship. Movement of the piston 84 toward the right permits the spring bias of the jaws to provide unclamping movement thereof as the first and second actuators 94 and 96 move toward the right and permit movement of the rollers 112 and 116 toward the right.

With the jaw construction disclosed, clamping jaw movement positions the race axis C at the same location regardless of slight manufacturing variations in the sizes of the races clamped. Thus, the clamping ends 40' and 42' of the jaws move in a coordinated manner with respect to each other such that each clamping insert 110 and 118 has its clamping surface spaced the same distance as each other one from the final location of the race axis C. Such clamping insures that the clamped race will be positioned in alignment with the grinding wheel 12.

A rotary coupling 140 shown in FIG. 2 has a plate 142 that is secured to the manifold 76 by circumferentially spaced bolts 144, only one of which is shown. A first fluid hose 146 connected to coupling 140 feeds a central passage 147 into the piston bore 86 on the right side of the piston 84 in order to cooperate with the spring 138 in biasing the piston toward the left and thereby providing a high clamp mode of the jaws 40 and 42 through the actuators 94 and 96. A second fluid hose 148 connected to rotary coupling 140 feeds passages 150 that communicate with an annular chamber 152 extending about a tube 154 that defines the central passage 147. An angular passage 156 in the manifold 76 extends from the chamber 152 and communicates with the right end of a passage 158 whose left end is communicated with the left side of the piston 84. Pressurized hydraulic fluid of a predetermined level fed through the hose 148 moves the piston 84 toward the left against its biasing spring 138 in order to provice an unclamp mode of the jaw operator 44 for unclamping the jaws as previously described. Pressurized hydraulic fluid of a somewhat lower level fed through the hose 148 partially relieves the biasing force of the piston spring 138 and thereby provides a low clamp mode for clamping the race with a lesser force than in the high clamp mode in order to facilitate the indexing and the locating of the race as the holder rotation proceeds.

With reference to FIG. 1, the indexer 46 is mounted on the holder adapter 30 at the second holder end 28 and includes an actuator having a hydraulic piston 160 for indexing the clamped race 16. Actuator piston 160 is received within a bore 162 in the holder adapter for slidable movement in a sealed relationship. A spring 164 of the indexer actuator encircles a reduced size connecting rod 166 of piston 160 and has a first end seated against the piston as well as a second end which is seated against a guide bushing 168 received within the outer end of the bore 162. Guide bushing 168 with its partial flange 170 is secured to holder adapter 30 by unknown bolts. A spacer 171 is interposed between flange 170 and holder 30 to locate the bushing 168 in order to control the extent of indexer piston movement by controlling the position of the bushing end **168*a* which is engaged by piston 160 upon full extension toward the right. A key 172 secured to bushing flange 170 by a bolt 173 includes a key portion 172*a* that is received within a slot 174 in piston connecting rod 166 so as to rotationally fix the piston 160 and its connecting rod. Spring 164 biases the piston 160 away from the guide bushing 168 in a retracting direction so as to engage a recessed piston surface 176 with a plug 178 mounted within the closed end of the piston bore as shown. Pressurized hydraulic fluid supplied through the drive mechanism 34 into a passage 180 defined by a central tube 182 is fed to a passage 184 in the spindle adapter 32 for flow to a passage 186 in the holder adapter 30 in order to extend the indexer piston 160 against the bias of spring 164 and provide indexing of the clamped race 16. An indexing member 188 of the indexer is mounted on the outer end of the indexer piston rod 166 and has a distal end including a carbide insert 189 that engages the adjacent race groove 18 to rotationally index the race about its axis C upon extension of piston 160**.

As previously mentioned, the jaws 40 and 42 shown in FIG. 2 are clamped in the low clamp mode in order to permit the race indexing by the indexer 46 shown in FIG. 1 as its piston 160 is hydraulically extended. Of course, the grinding wheel 12 has previously been moved away from the clamped race in order to permit the indexing to be performed prior to movement back into rotating engagement with the race for grinding the aligned pair of diametrically opposite race grooves 18.

Indexing member 188 shown in FIG. 1 is pivotally mounted by a pin 190 on the outer end of the piston connecting rod 166 and has a stop surface 192 that is engageable with a stop surface 194 on the piston in order to limit counterclockwise pivoting of the indexing member. A hole 196 in the piston slidably receives a plunger 198 whose inner end has a hollow construction that receives a spring 200. One end of the spring 200 is seated with the end of the hole 196 in the piston while the other end thereof is seated with the outer end of plunger 198 so as to bias the plunger in an extending direction into engagement with a pin 202 mounted on the indexing member 188. As such, the bias of the spring 200 normally maintains the stop surface 192 on the indexing member in engagement with the stop surface 194 on the piston so as to position the indexing member such that its carbide insert 189 will engage the adjacent race groove to provide counterclockwise indexing thereof about axis C as the piston 160 is hydraulically extended. The indexer piston 160 preferably moves along a direction that defines an angle of approximately 12° with the axis B of holder rotation. This relationship permits indexing member 188 to be extended on the piston rod 166 throughout a full indexing stroke without any clockwise pivoting that would disengage the stop surfaces 192 and 194. As such, the force necessary to index the clamped race 16 is carried by the stop surfaces throughout the indexing stroke.

After extension of the piston 160 sufficiently to index the race for grinding of the next adjacent pair of diametrically opposite grooves 18, the pressurized hydraulic fluid which extends the piston is exhausted in order to permit the piston spring 164 to retract the piston. Indexing member 188 pivots clockwise about its mounting pin 190 during such retraction so that the end thereof at which the carbide insert 189 is located can move back out of the race groove 18 which was just previously engaged thereby to index the race. Plunger 198 moves inwardly against the bias of spring 200 as the indexing member 188 pivots clockwise about pin 190 and is subsequently moved outwardly by this spring in order to pivot the indexing member counterclockwise about its mounting pin so that the stop surface 192 thereon is again engaged with the stop surface 194 on the piston ready for the next indexing cycle.

A sensor 204 shown in FIG. 1 is associated with the indexer 46 to sense the location of its piston 160 so as to insure that the grinding wheel 12 is not moved toward the race 16 clamped on the holder until after the indexing member 188 has moved out of the race groove 18 that is aligned with the wheel. The sensor 204 includes a proximity switch 206 mounted on the machine base and responsive to an actuator 208 that is supported for rotation on the outer end of a lever 210 that rotates with the spindle adapter 32. The inner end of lever 210 is pivotally supported by a pin 212 on the spindle adapter 32. Intermediate its ends, the lever 210 is engaged by a plunger 214 that is biased by a spring 216 so as to bias the lever counterclockwise about pin 212 and into engagement with a pin 218 that extends through the plug 178 and is mounted by the piston 160. As such, the lever 210 is pivoted counterclockwise about pin 212 when the piston 160 is extended to provide indexing and the actuator 208 is then moved away from the proximity switch 206 in order to provide a signal that the indexer piston isn't fully retracted. Upon retracting movement of the indexer piston 160, the piston pin 218 moves the lever 210 clockwise about pin 212 against the spring bias of plunger 214 and back into proximity with the switch 206 so as to sense the location thereof during each revolution and thereby provide a signal that the indexer piston is retracted and that the grinding wheel can be moved toward the holder 14 for grinding of the clamped race 16.

Locater 48 shown in FIG. 1 is mounted on the holder adapter 30 at the second holder end 28 in order to provide accurate rotational positioning of the clamped race 16 after the indexing operation provided by indexer 46. An actuator of the locater 48 includes a hydraulic piston 220 and a spring 222 that biases the locater piston in an extending direction within the bore 224 in the holder adapter 30. Piston 220 includes a connecting rod 226 with a distal threaded end 228 on which a ball shaped locating member 230 is secured. Extending movement of the piston 220 engages the ball 230 with the adjacent race groove 18 so as to provide accurate rotational positioning of the race 16 about its central axis C and thereby accurately align the two diametrically opposite grooves to be ground with the grinding wheel 12. Piston 220 also includes a connecting rod 231 encircled by spring 222 and extending outwardly through a bore end closure 232 that is secured by threaded bolts 234 to the holder adapter 30. One end of the spring 222 is seated by the closure 232 while the other end thereof is seated against the piston 222 in order to provide an extending bias of the piston.

Prior to indexing, pressurized hydraulic fluid is supplied through a passage 236 in the holder adapter 30 to the locater 48 within its piston bore 224 so as to move the piston 220 in a retracting direction against the bias of spring 222 such that the locating member 230 is retracted from the clamped race 16 in order to allow the rotational indexing about axis C. After indexing, the pressurized hydraulic fluid from passage 236 is exhausted and pressurized hydraulic fluid is then supplied to a holder adapter passage 238 that communicates with the piston bore 224 on the other side of piston 220 in order to provide extending movement of the piston in cooperation with the biasing spring 222 and thereby provide accurate rotational positioning of the indexed race.

Piston rod 226 shown in FIG. 1 extends through a bore closure 240 that is secured to the holder adapter 30 by bolts 242. A grease fitting 244 is communicated with piston rod 226 in order to facilitate the extending and retracting movement of the rod while maintaining the sealed relationship of the piston bore 224. This piston movement is provided by pressurized hydraulic fluid that is selectively fed to the passages 236 and 238 in the holder adapter 30 by passage 244 and 246 in the spindle adapter 32. Passage 244 is fed pressurized hydraulic fluid from a passage 248 that is defined between a tube 250 and the tube 182 whose interior defines the passage 180 that actuates the indexer 46. Passage 246 is fed pressurized hydraulic fluid from a passage 252 defined between the tube 250 and an outer tube 254. A hole 256 through tube 254 communicates the passage 246 with the passage 252 while an annular closure 258 extending between the ends of tubes 252 and 254 isolates the pressurized hydraulic fluid fed to passages 244 and 246. Both passages 248 and 252, like passage 180, are fed pressurized hydraulic fluid through the machine drive mechanism 34 by conventional apparatus.

A sensor 260 shown in FIG. 1 is associated with the locater 48 to provide a signal that is responsive to the extended position of the locater piston 220. A proximity switch 262 of the sensor 260 is mounted by a stationary arm structure 264 on a portion of the machine base and is responsive to the proximity of a switch actuator 266 that is supported for rotation on a mount 268 carried by the outer end of the piston rod 231. A guide pin 270 mounted on the bore closure 232 is received by a hole 272 in mount 268 so as to prevent pivoting thereof about the end of piston rod 231 as the rotation of the holder adapter 30 proceeds.

Extending movement of the locater piston 220 as previously described locates the actuator 266 for passage past switch 262 in proximity thereto during each revolution so that sensor 260 provides a signal for preventing the indexer 46 from operating with the locating member 230 positioned within the adjacent race groove 18. This signal also provides an indication that a pair of race grooves 18 is aligned with the grinding wheel 12 so as to permit movement thereof toward the holder to begin grinding. Retraction of the locater piston 220 as previously described moves the switch actuator 266 out of relative proximity with the switch 262 so as to provide a signal that indicates there is no assurance the race 16 is positioned with a pair of grooves 18 aligned with the grinding wheel 12. As such, the grinding wheel is then prevented from moving toward the holder.

OPERATION

A grinding operation on a race 16 begins with the grinding wheel 12 moved away from the holder 14 in the direction of arrow 21 and with both the indexer 46 and the locater 48 in their retracted positions so that a race can be loaded onto the holder in preparation for grinding. Jaw operator 44 shown in FIG. 2 is then operated to move the jaws 40 and 42 from their unclamp mode to the low clamp mode such that the clamped race 16 can be rotated about its axis C. Rotation of holder 14 then begins and indexer 46 shown in FIG. 1 is extended so as to rotate the race 16 about its central axis C and thereby insure that one of the race grooves 18 will be generally in alignment with locating member 230 of the locater 48. Extending operation of the locater 48 then accurately locates the race 16 about its axis C in the manner previously described so as to insure that a pair of the diametrically opposite grooves 18 is aligned with the grinding wheel 12. Jaw operator 44 shown in FIG. 2 is then switched to its high clamp mode in preparation for grinding the two race grooves 18 aligned with the grinding wheel and the piston of indexer 46 is thereafter retracted. Subsequently, grinding wheel 12 is moved in the direction of arrow 20 toward the clamped race so as to provide grinding as the holder rotates with the race clamped between the jaws.

After the first pair of grooves 18 is ground, the grinding wheel 12 is moved away from the rotating holder 14 as its rotation proceeds and the jaw operator 44 shown in FIG. 2 is switched to its low clamp mode while the locater 48 is moved to a retracted position so that indexing can be performed. Indexer 46 is then extended so as to rotationally index the race 16 and approximately align the next pair of diametrically opposite race grooves 18 with the grinding wheel 12. Thereafter, the locater 48 is extended to accurately position the race 16 about axis C in order to align the next pair of grooves 18 to be ground with the grinding wheel 12 prior to switching the jaw operator 44 shown in FIG. 2 to its high clamp mode in preparation for indexer retraction and grinding wheel movement toward the race to perform the grinding.

After the last pair of race grooves 18 is ground, the rotation of the holder 14 is terminated and the locater 48 is retracted while the jaw operator 44 shown in FIG. 2 is switched to its unclamp mode so as to permit unloading of the ground race.

While the best mode for carrying out the invention has herein been described in detail, those familiar with the art to which this invention relates will recognize various alternative designs and embodiments for practicing the invention as defined by the following claims.

What is claimed is:

1. In apparatus including a rotatable grinding wheel and a rotatable holder for supporting the inner race of a constant velocity universal joint about a rotational axis so as to grind circumferentially spaced pairs of grooves on diametrically opposite sides of a central axis of the race by grinding one pair of the grooves at a time, the improvement comprising: a clamp including a pair of jaws mounted on the holder for movement with respect thereto and with respect to each other; the clamp also including an operator that rotates with the holder and has a high clamp mode for positioning the jaws so as to hold the race therebetween in a fixed relationship with the central axis of the race at a predetermined location on the holder during grinding of each pair of grooves; the jaw operator having a low clamp mode for permitting indexing movement of the race about the central axis thereof on the holder as the holder rotation proceeds; and indexing means that rotates with the holder and indexes the race about the central axis thereof with the jaw operator in its low clamp mode such that the indexing is performed as the holder rotation continues and the apparatus thereby grinds each pair of grooves in the race without stopping the holder rotation.

2. In apparatus including a rotatable grinding wheel and a rotatable holder for supporting the inner race of a constant velocity universal joint about a rotational axis so as to grind circumferentially spaced pairs of grooves on diametrically opposite sides of a central axis of the race by grinding one pair of the grooves at a time, the improvement comprising: a clamp including a pair of jaws mounted on the holder for movement with respect thereto and with respect to each other; the clamp also including an operator that rotates with the holder and has a high clamp mode for positioning the jaws to hold the race therebetween in a fixed relationship with the central axis of the race at a predetermined location on the holder during grinding of each pair of grooves; the jaw operator having a low clamp mode which permits indexing movement of the race about the central axis thereof on the holder as the holder rotation proceeds; indexing means that rotates with the holder and indexes the race about the central axis thereof without stopping the holder rotation; and a locater that rotates with the holder and locates the race about the central axis thereof in cooperation with the clamp prior to grinding each pair of grooves in order to provide proper alignment with the grinding wheel.

3. In apparatus including a rotatable grinding wheel and a rotatable holder for supporting the inner race of a constant velocity universal joint about a rotational axis so as to grind circumferentially spaced pairs of grooves on diametrically opposite sides of a central axis of the race by grinding one pair of the grooves at a time, the improvement comprising: a clamp including first and second jaws pivotally mounted on the holder for movement with respect thereto and with respect to each other; the clamp also including a fluid jaw operator having a high clamp mode for positioning the jaws so as to hold the race therebetween in a fixed relationship with the central axis of the race at a predetermine location on the holder during grinding of each pair of grooves; the jaw operator having a low clamp mode for permitting indexing and locating movement of the race about the central axis thereof on the holder as the holder rotation proceeds; indexing means that rotates with the holder and includes a fluid actuator for actuating indexing of the race about the central axis thereof with the jaw operator in its low clamp mode such that the indexing is performed without stopping the holder rotation; and a locator that rotates with the holder and has a fluid actuator for providing actuation thereof so as to locate the race about the central axis thereof with the jaw operator in its low clamp mode prior to grinding each pair of grooves in order to provide proper alignment with the grinding wheel.

4. Apparatus as in claim 3, wherein the holder includes first and second ends on which the first and second jaws are respectively mounted, the holder also including a reduced size connecting portion that defines a mounting face between the ends of the holder, each jaw having a pivotal connection to the holder with an axis that extends parallel to the mounting face of the holder on the associated end thereof, each jaw also having a clamping end for engaging the inner race to provide clamping thereof against the mounting face of the holder in cooperation with the other jaw, the jaw operator being mounted on the first end of the holder and including a first actuator that engages the first jaw on the same side of the pivotal axis thereof as its clamping end in order to provide a clamping bias thereof toward the second jaw, the jaw operator also including a second actuator that extends through the connecting portion of the holder from the jaw operator to the secon end of the holder so as to engage the second jaw on the operator side of the pivotal axis thereof as its clamping end in order to provide a clamping bias thereof toward the first jaw upon biasing of the second jaw actuator by the jaw operator in the same direction that provides the clamping bias of the first jaw by the first actuator, and the clamping ends of the jaws being moved in coordination with each other by their associated actuators so as to accurately locate each race clamped thereby despite size variations of the races.

5. Apparatus as claim 4 wherein the clamping end of the first jaw includes a pair of clamping portions that are spaced circumferentially with respect to the race clamped thereby, and the clamping end of the second jaw including a single clamping portion that engages the race clamped thereby in an equal circumferentially spaced relationship from each clamping portion of the first jaw.

6. Apparatus as in claim 4 wherein the jaw operator includes a piston and a spring that biases the piston in a direction that moves the first and second actuators of the jaw operator so as to provide the clamping bias of the jaws, a first passage for selectively feeding pressurized fluid to one side of the piston so as to cooperate with the spring to provide the high clamp mode of the operator, and a second passage for selectively feeding pressurized fluid to the other side of this piston so as to urge the piston against the spring bias thereof in order to provide the low clamp mode of the operator.

7. Apparatus as in claim 4 or 6 wherein the said indexing means and the locater are both mounted at the second end of the holder and wherein the actuator of each includes a piston and a biasing spring.

8. Apparatus as in claim 7 wherein the actuator of said indexing means includes an indexing member mounted for movement with the piston thereof, the spring of the indexer actuator biasing the piston thereof in a retracting direction so as to move the indexing member away from the race clamped by the jaws, and a passage for supplying pressurized fluid to the indexer piston to provide extending movement thereof against its spring bias so as to engage the indexing member with the race and provide the indexing movement of the race with the race clamped by the jaws in the low clamp mode of the jaw operator.

9. Apparatus as in claim 8 further including a pivotal connection that mounts the indexing member on the piston of the indexer actuator, engageable stop surfaces on the indexer piston and the indexing member for limiting pivoting of the indexing member as the pressurized fluid moves the indexer piston to index the clamped race, and a spring that biases the indexing member so as to engage the stop surfaces and which deflects to permit disengagement of the stop surfaces as the indexer piston is moved by its spring bias in the retracting direction after indexing the clamped race.

10. Apparatus as in claim 9 wherein the piston of the indexer actuator moves in a direction that defines an angle of approximately 12° with axis of holder rotation such that indexing can be performed without any pivoting of the indexing member and consequent disengagement of the stop surfaces.

11. Aparatus as in claim 8 further including a sensor that senses the location of the indexer piston so as to prevent the grinding wheel from engaging the indexing member.

12. Apparatus as in claim 7 wherein the locater includes a locating member movable with the piston of the locater actuator, the spring of the locater actuator biasing the piston thereof in an extending direction so as to engage the locating member with the race to provide locating movement thereof with the race clamped by the jaws in the low clamp mode of the jaw operator, and passages for supplying pressurized fluid to the locater piston to selectively provide the extending movement thereof as well as an opposite retracting movement.

13. Apparatus as in claim 12 further including a sensor for sensing the location of the locater piston to ensure that the clamped race is located prior to commencement of grinding each pair of grooves.

14. In apparatus including a rotatable grinding wheel and a rotatable holder for supporting the inner race of a constant velocity universal joint about a rotational axis so as to grind circumferentially spaced pairs of grooves on diametrically opposite sides of a central axis is the race by grinding one pair of the grooves at a time, the improvement comprising: a clamp including first and second jaws pivotally mounted on the holder for movement with respect thereto and with respect to each other; the holder including first and second ends on which the first and second jaws are respectively mounted; the holder also including a reduced size connecting portion that defines a mounting face between the ends of the holder; each jaw having a pivotal connection with an axis that extends parallel to the mounting face of the holder on the associated end thereof; each jaw also having a clamping end for engaging the inner race to provide clamping thereof between the jaws against the mounting face of the holder; a fluid jaw operator mounted on the first end of the holder for rotation therewith and including a first actuator that engages the first jaw on the same side of the pivotal axis thereof as its clamping end in order to provide a clamping bias thereof toward the second jaw; the jaw operator also including a second actuator that extends through the connecting portion of the holder from the jaw operator to the second end of the holder so as to engage the second jaw on the opposite side of the pivotal axis thereof as its clamping end in order to provide a clamping bias thereof toward the first jaw upon biasing of the second actuator in the same direction that provides the clamping bias of the first jaw by the first actuator; the clamping ends of the jaws being moved in coordination with each other by their associated actuators so as to accurately locate each race clamped on the holder with the central axis of the race at a predetermined location on the holder despite size variations of the races; the jaw operator having a high clamp mode for biasing the actuators and the jaws engaged thereby so as to hold the race in a fixed relationship on the holder during grinding of each pair of grooves; the jaw operator having a low clamp mode for biasing the actuators and the jaws engaged thereby so as to permit indexing and locating movement of the race about the central axis thereof on the holder as the holder rotation proceeds; indexing means mounted on the second end of the holder for rotation therewith and including a fluid actuator for actuating indexing of the race about the central axis thereof with the jaw operator in its low clamp mode such that the indexing is performed without stopping the holder rotation; and a locater mounted on the second end of the holder for rotation therewith and including a fluid actuator for providing actuation thereof so as to locate the race about the central axis thereof with the jaw operator in its low clamp mode prior to grinding each pair of grooves in order to provide proper alignment with the grinding wheel.

15. In apparatus including a rotatable grinding wheel and a rotatable holder for supporting the inner race of a constant velocity universal joint about a rotational axis so as to grind circumferentially spaced pairs of diametrically opposite grooves in the race by grinding one pair of the grooves at a time, the improvement comprising: a clamp including first and second jaws pivotally mounted on the holder so as to provide clamping of the inner race to be ground; the holder including first and second ends on which the first and second jaws are respectively mounted; the holder also including a reduced sized connecting portion that defines a mounting face between the ends of the holder; each jaw having a pivotal connection with an axis that extends parallel to the mounting face of the holder on the associated end thereof; each jaw also having a clamping end for engaging the inner race to provide clamping thereof against the mounting face of the holder in cooperation with the other jaw; the clamping end of the first jaw including a pair of clamping portions that are spaced circumferentially with respect to the race clamped thereby; the clamping end of the second jaw including a single clamping portion that engages the race clamped thereby in an equal circumferentially spaced relationship from each clamping portion of the first jaw; springs that bias the jaws toward an unclamped position; a fluid jaw operator mounted on the first end of the holder and including a first actuator that engages the first jaw on the same side of the pivotal axis thereof as its clamping end in order to provide a clamping bias thereof toward the second jaw; the jaw operator also including a second actuator that extends through the connecting portion of the holder from the jaw operator to the second end of the holder so as to engage the second jaw on the opposite side of the pivotal axis thereof as its clamping end in order to provide a clamping bias thereof toward the first jaw upon biasing of the second actuator in the same direction that provides the clamping bias of the first jaw; the jaw operator including a piston and a spring that biases the piston in a direction that moves the first and second actuators of the jaw operator so as to provide the clamping bias of the jaws; the clamping ends of the jaws being moved in coordination with each other by their associated actuators so as to accurately locate each race clamped thereby despite size variations of the races; a passage for selectively feeding pressurized fluid to one side of the jaw operator piston so as to cooperate with the spring to provide a high clamp mode for biasing the jaw actuators and the jaws engaged thereby to thereby hold the race in a fixed relationship on the holder during grinding of each pair of grooves; a passage for selectively feeding pressurized fluid to the other side of the jaw operator piston so as to urge this piston against the spring bias thereof in order to provide a low clamp mode for biasing the jaw actuators and the jaws engaged thereby to permit indexing and locating movement of the race on the holder as the holder rotation proceeds; an indexing means including a piston mounted on the second end of the holder for rotation therewith; an indexing member mounted for movement with the indexer piston; a spring for biasing the indexer piston in a retracting direction so as to move the indexing member away from the race clamped by the jaws; a passage for supplying pressurized fluid to the indexer piston to provide extending movement thereof against its spring bias so as to engage the indexing member with the race and provide the indexing movement of the race with the race clamped by the jaws in the low clamp mode of the jaw operator such that the apparatus grinds each pair of grooves in the race without stopping the holder rotation; a locater including a piston mounted on the second end of the holder for rotation therewith; a locating member movable with the piston of the locater;

a spring for biasing the locater piston in an extending direction so as to engage the locating member with the race to provide locating movement thereof with the race clamped by the jaws in the low clamp mode of the jaw operator prior to grinding each pair of grooves in order to provide proper alignment with the grinding wheel; and passages for supplying pressurized fluid to the locater piston to selectively provide the extending movement thereof as well as an opposite retracting movement.

* * * * *

UNITED STATES PATENT AND TRADEMARK OFFICE

CERTIFICATE OF CORRECTION

PATENT NO. : 4,312,155

DATED : January 26, 1982

INVENTOR(S) : Kazimierz J. Reda et al

It is certified that error appears in the above—identified patent and that said Letters Patent is hereby corrected as shown below:

On The Title Page:

Abstract, first line, insert "disclosed" after --(10)--.

Column 2, line 4, "is" should be --in--.

Column 2, line 8, "induxing" should be --indexing--.

Column 3, line 49, "the" should be --and--.

Column 5, line 38, "ad" should be --and--.

Column 5, line 42, "than" should be --that--.

Column 7, line 10, "axic" should be --axis--.

Column 8, line 58, "unknown" should be --unshown--.

UNITED STATES PATENT AND TRADEMARK OFFICE

CERTIFICATE OF CORRECTION

PATENT NO. : 4,312,155

DATED : January 26, 1982

INVENTOR(S) : Kazimierz J. Reda et al

It is certified that error appears in the above—identified patent and that said Letters Patent is hereby corrected as shown below:

Claim 4, line 62, "operator" should be --opposite--.

Claim 14, line 11, "is" should be --of--.

Signed and Sealed this

*Eighth* Day of *June 1982*

[SEAL]

*Attest:*

GERALD J. MOSSINGHOFF

*Attesting Officer*

*Commissioner of Patents and Trademarks*